US008595886B2

(12) United States Patent
Edelstein et al.

(10) Patent No.: US 8,595,886 B2
(45) Date of Patent: Dec. 3, 2013

(54) BRISTLE CONFIGURATION

(75) Inventors: Janette Suh Edelstein, Belle Mead, NJ (US); Stephen J. Blanchard, London (GB)

(73) Assignee: Dr. Fresh, LLC, Buena Park, CA (US)

( * ) Notice: Subject to any disclaimer, the term of this patent is extended or adjusted under 35 U.S.C. 154(b) by 183 days.

(21) Appl. No.: 13/161,944

(22) Filed: Jun. 16, 2011

(65) Prior Publication Data

US 2011/0308029 A1 Dec. 22, 2011

Related U.S. Application Data

(63) Continuation-in-part of application No. 29/363,963, filed on Jun. 16, 2010, now Pat. No. Des. 660,003.

(60) Provisional application No. 61/355,894, filed on Jun. 17, 2010.

(51) Int. Cl.
*A46B 13/02* (2006.01)

(52) U.S. Cl.
USPC ..... 15/167.1; 15/207.2; 15/22.1

(58) Field of Classification Search
USPC ..... 15/167.1, 167.2, 22.1, 207.2, 22.2, 110, 15/111, DIG. 5; D4/104
See application file for complete search history.

(56) References Cited

U.S. PATENT DOCUMENTS

| | | | |
|---|---|---|---|
| 218,431 | A | 8/1879 | Dunham |
| 1,943,225 | A | 1/1934 | McIntyre |
| 2,042,239 | A | 5/1936 | Planding |
| 2,088,839 | A | 8/1937 | Coney et al. |
| 2,168,964 | A | 8/1939 | Strasser |
| 2,209,173 | A | 7/1940 | Russell |
| 2,242,743 | A | 5/1941 | Brown |
| 2,244,699 | A | 6/1941 | Hosey |
| 2,279,355 | A | 4/1942 | Wilensky |
| 2,443,461 | A | 6/1948 | Kempster |
| 2,797,424 | A | 7/1957 | Olson |
| 2,879,533 | A | 3/1959 | Ward |
| 3,085,273 | A | 4/1963 | Cowan |
| D197,696 | S | 3/1964 | Vallis |
| 3,229,318 | A | 1/1966 | Clemens |
| 3,731,336 | A | 5/1973 | Rubin |
| 4,081,876 | A | 4/1978 | Pugh |
| 4,268,933 | A | 5/1981 | Papas |

(Continued)

FOREIGN PATENT DOCUMENTS

| | | |
|---|---|---|
| JP | 203019031 | 1/2003 |
| JP | 2007143908 | 6/2007 |

(Continued)

*Primary Examiner* — Shay Karls
(74) *Attorney, Agent, or Firm* — Snell & Wilmer LLP

(57) ABSTRACT

A bristle configuration providing enhanced cleaning of teeth. At least one elongated bristle tuft is formed to at least partially enclose an area, and a complementary-shaped tuft is provided in the at least partially enclosed area. The elongated tuft and the complementary tuft have angled profiles angled to a different degree, and preferably also in a different direction. A series of elongated tufts with angled profiles may be provided to form an overall bristle profile providing enhanced cleaning of teeth. In addition, one or more tufts may be provided along the elongated tufts to form another tuft pattern along the pattern formed by the elongated tufts. In one embodiment, the other tuft pattern presents a contoured bristle profile angled to a different degree from the profile of the elongated tufts along which the other tuft pattern is provided.

20 Claims, 2 Drawing Sheets

(56) References Cited

U.S. PATENT DOCUMENTS

| | | | |
|---|---|---|---|
| D332,873 | S | 2/1993 | Hall |
| 5,609,890 | A | 3/1997 | Boucherie |
| 5,628,082 | A | 5/1997 | Moskovich |
| 5,735,011 | A | 4/1998 | Asher |
| 5,799,353 | A | 9/1998 | Oishi et al. |
| D402,114 | S | 12/1998 | Fleming et al. |
| D402,116 | S | 12/1998 | Magloff et al. |
| D402,471 | S | 12/1998 | Magloff et al. |
| D403,510 | S | 1/1999 | Menke |
| 5,896,614 | A | 4/1999 | Flewitt |
| 5,991,959 | A | 11/1999 | Raven et al. |
| D422,143 | S | 4/2000 | Beals et al. |
| D424,808 | S | 5/2000 | Beals et al. |
| D425,306 | S | 5/2000 | Beals et al. |
| 6,272,714 | B2 | 8/2001 | Beals |
| 6,276,021 | B1 | 8/2001 | Hohlbein |
| D448,569 | S | 10/2001 | Harris et al. |
| 6,308,367 | B1 | 10/2001 | Beals et al. |
| 6,370,726 | B1 | 4/2002 | Kini et al. |
| 6,405,401 | B1 | 6/2002 | Hellerud |
| 6,421,867 | B1 | 7/2002 | Weihrauch |
| 6,513,182 | B1 | 2/2003 | Calabrese et al. |
| 6,564,416 | B1 | 5/2003 | Claire et al. |
| 6,582,028 | B2 | 6/2003 | Buchholz |
| 6,643,886 | B2 | 11/2003 | Moskovich et al. |
| D483,184 | S | 12/2003 | Geiberger et al. |
| 6,820,299 | B2 | 11/2004 | Gavney, Jr. et al. |
| 7,386,909 | B2 | 6/2008 | Hohlbein |
| 7,480,955 | B2 | 1/2009 | Hohlbein et al. |
| 7,546,658 | B2 * | 6/2009 | Koeth et al. ..... 15/167.1 |
| 7,703,163 | B2 * | 4/2010 | Jimenez et al. ..... 15/22.1 |
| D623,413 | S | 9/2010 | Blanchard et al. |
| 2003/0229959 | A1 | 12/2003 | Gavney, Jr. et al. |
| 2005/0166341 | A1 | 8/2005 | Solanki |
| 2005/0268414 | A1 | 12/2005 | Kim |
| 2006/0048323 | A1 | 3/2006 | Rueb |
| 2006/0107478 | A1 | 5/2006 | Boucherie |
| 2006/0162108 | A1 | 7/2006 | Georgi |
| 2006/0236482 | A1 | 10/2006 | Georgi |
| 2007/0033757 | A1 | 2/2007 | Storkel et al. |
| 2007/0251040 | A1 | 11/2007 | Braun et al. |
| 2008/0028558 | A1 | 2/2008 | Kwon |
| 2008/0178401 | A1 | 7/2008 | Claire-Zimmet et al. |
| 2008/0201886 | A1 | 8/2008 | Bielfeldt et al. |
| 2008/0209649 | A1 | 9/2008 | Herzog |
| 2009/0094768 | A1 | 4/2009 | Hohlbein et al. |
| 2009/0158543 | A1 | 6/2009 | Lee |
| 2009/0255077 | A1 | 10/2009 | Mori et al. |
| 2010/0263148 | A1 | 10/2010 | Jimenez et al. |
| 2011/0047736 | A1 | 3/2011 | Jimenez et al. |

FOREIGN PATENT DOCUMENTS

| | | |
|---|---|---|
| JP | 2007151704 | 6/2007 |
| JP | 2007151795 | 6/2007 |
| JP | 2007175526 | 7/2007 |
| JP | 2008154808 | 7/2008 |
| KR | 10-0414458 | 4/2004 |
| WO | 97/20484 | 6/1997 |
| WO | 2007/032955 | 3/2007 |

* cited by examiner

BRISTLE CONFIGURATION

CROSS-REFERENCE TO RELATED APPLICATION

The present application claims the benefit of the earlier filing date of provisional application 61/355,894, filed Jun. 17, 2010, and is a continuation-in-part of and claims the benefit of the earlier filing date of design patent application No. 29/363,963, filed Jun. 16, 2010, now U.S. Pat. No. Des. 660,003 which applications are hereby incorporated by reference herein in their entireties.

FIELD OF THE INVENTION

The present invention relates to toothbrush bristle profiles. More particularly, the present invention relates to unique bristle tuft profiles.

BACKGROUND OF THE INVENTION

Toothbrushes generally have a plurality of bristle tufts, each tuft having a plurality of bristles, for removing plaque and debris from tooth surfaces. Typically, bristle tufts are configured for brushing the outer surfaces of the teeth, i.e., the buccal (cheek-facing), lingual (tongue facing), and occlusal (chewing) surfaces of the teeth. Dental floss is effective in removing plaque and debris from interdental or interproximal surfaces. However, not all individuals floss on a regular basis, and some individual hardly floss at all. Accordingly, it is desirable for toothbrush bristle profiles (the contour of the free cleaning/brushing/tooth-engaging ends of the bristles as seen from a side elevational view) to be designed to remove plaque and debris not only from the outer surfaces of the teeth but also from the interdental surfaces of the teeth.

Commercially available toothbrushes with flat bristle profiles (i.e., all free ends of the bristles are on substantially the same level or, in other words, are coplanar) clean the outer surfaces of teeth adequately, but are not always as adept at cleaning interdental surfaces and providing interdental stimulation as are toothbrushes with contoured bristle profiles (having free ends at differing heights). Various bristle profiles, such as a repeating "V"-shaped (aka, sawtooth or zigzag) profile, are known to increase the cleaning and gum-stimulating efficacy of toothbrushes.

Commercial toothbrushes typically have a brushing surface area (the surface area occupied by bristle free ends) of approximately 1 to 1.25 inches (25.4 to 35.8 mm) long and 5/16 to 3/8 inches (7.9 to 9.5 mm) wide. The bristles are generally arranged in 4 to 6 longitudinally extending (i.e., from the distal to the proximal end of the head, or, in other words, from the tip of the head towards the handle) rows of bristle tufts with 5 to 14 tufts per row, and approximately 20 to 50 bristles per tuft. Typical tufts are approximately 0.063 inches (1.6 mm) in diameter, with a cross-sectional area of approximately 0.079 inches$^2$ (2 mm$^2$). The diameters of commonly used bristles are: 0.006 inch (0.15 mm) for soft bristles, 0.008 inch (0.2 mm) for medium bristles, and 0.010 inch (0.25 mm) for hard bristles. The diameter of the bristles used in the brush, or increasing the tuft area, generally increases the stiffness of the bristles or tufts, and generally extends the life of the brush. However, such increases generally negatively affect the interdental cleaning of the brush, as well as the wear on the gums because the bristles are not as readily moved or bent to fit in the interdental spaces.

Accordingly, there is a continuing desire to improve the interdental cleaning ability of toothbrushes, especially since many individuals do not floss. Moreover, there is a desire to increases the life of the brush.

SUMMARY OF THE INVENTION

In accordance with the principles of the present invention, a toothbrush is formed with a bristle profile providing superior interdental cleaning. In accordance with one aspect of the present invention, at least one elongated bristle tuft is formed to at least partially enclose an area, and a complementary-shaped tuft is provided in the at least partially enclosed area. The elongated tuft and the complementary tuft have angled profiles angled to a different degree, and preferably also in a different direction. Accordingly, the bristle profile is not simply an ornamental configuration, but also provides enhanced interdental cleaning.

In accordance with another aspect of the present invention, a series of elongated tufts with angled profiles may be provided to form an overall bristle profile providing enhanced cleaning of teeth. In one embodiment, the elongated tufts are angled in different directions such that the overall arrangement imparts a unique bristle profile that is available for cleaning teeth.

BRIEF DESCRIPTION OF THE DRAWINGS

While the specification concludes with claims which particularly point out and distinctly claiming the invention, it is believed the present invention will be better understood from the following detailed description in conjunction with the accompanying drawings, in which like reference numerals identify like elements and wherein:

DETAILED DESCRIPTION OF THE INVENTION

Figure 1:
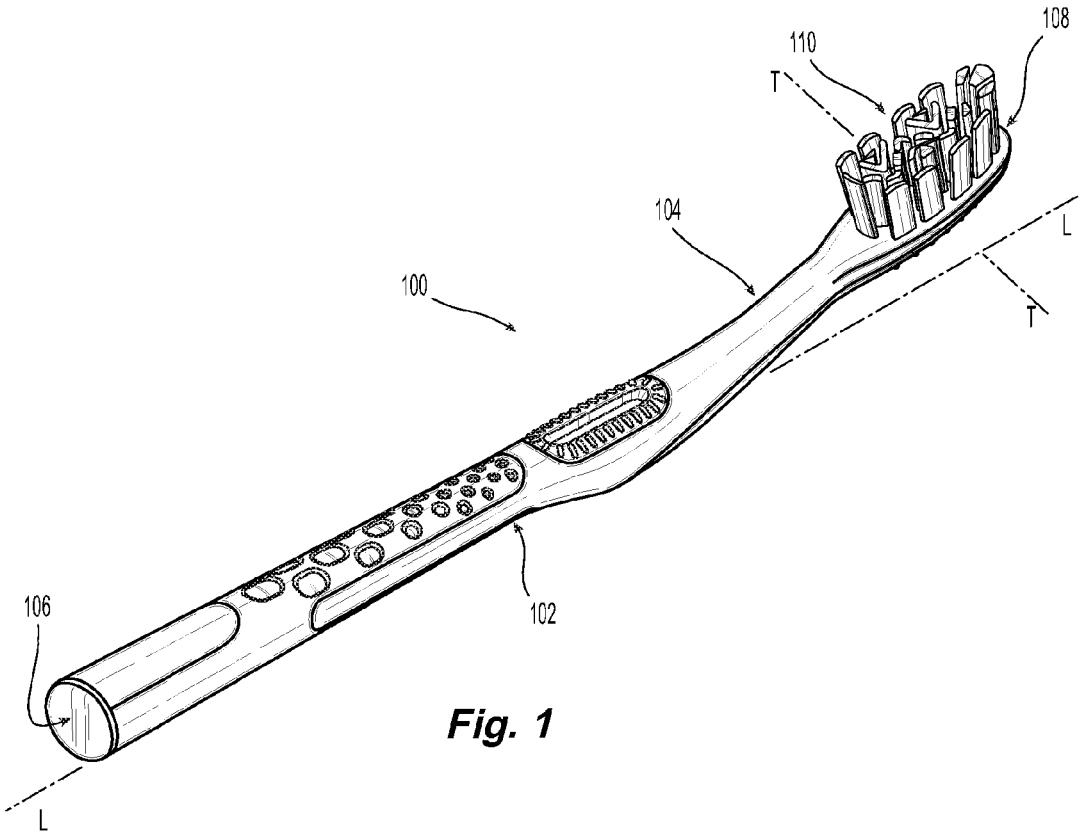
FIG. 1 is a perspective view of an exemplary toothbrush having one or more bristle profiles formed in accordance with the principles of the present invention.
Figure 2:
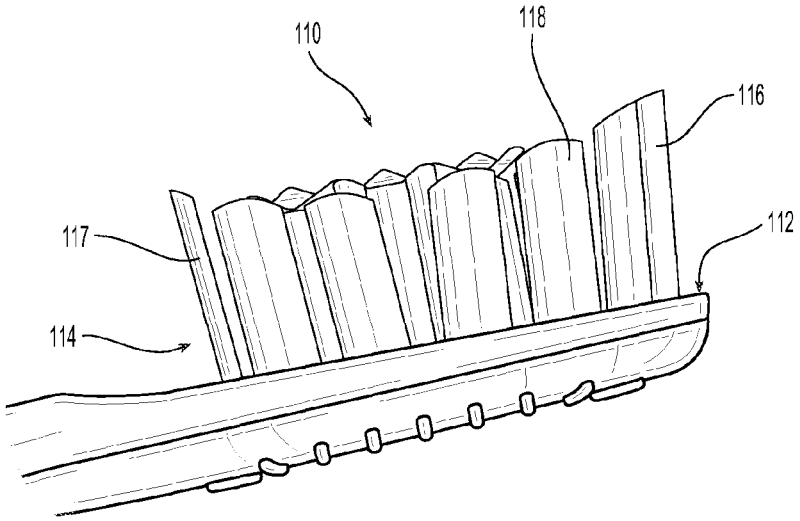
FIG. 2 is an isolated enlarged side elevational view of the head of the toothbrush shown in FIG. 1.
Figure 3:
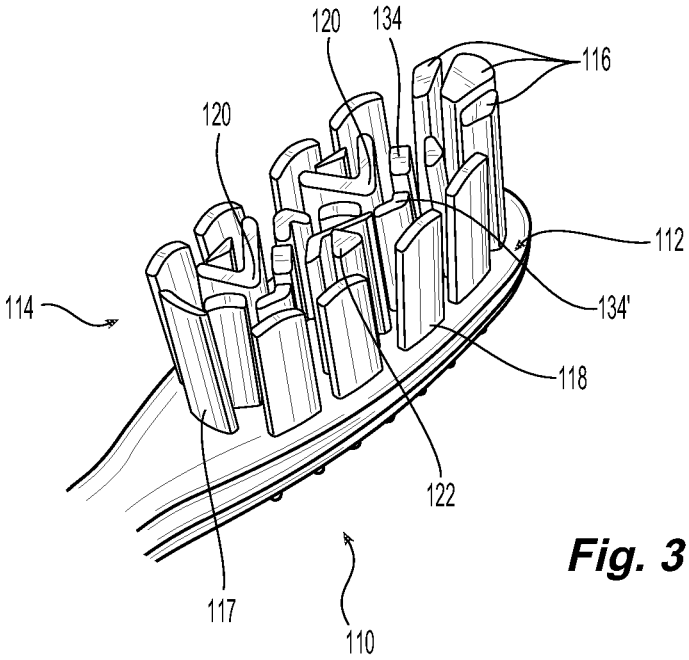
FIG. 3 is an isolated enlarged perspective view of the head shown in FIG. 2.
Figure 4:
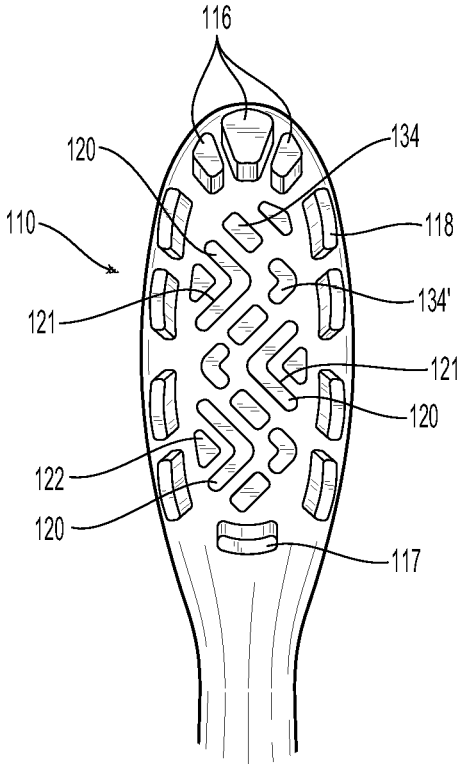
FIG. 4 is an isolated enlarged plan view of the head shown in FIG. 2.

An exemplary toothbrush 100 to which the principles of the present invention may be applied is illustrated in FIG. 1, with head 110 shown in isolation in FIGS. 2, 3, and 4. Handle portion 102 and neck portion 104 of exemplary toothbrush 100 are angled with respect to each other, but need not be for purposes of the present invention. Toothbrush 100 has a proximal end 106 (at which handle 102 is provided for grasping by a user) and a distal end 108 (at which head 110 is provided) along longitudinal direction L. Longitudinal direction L is defined herein as the direction extending generally along the length of toothbrush 100 between proximal end 106 and distal end 108. Longitudinal direction L may extend along handle portion 102 or neck portion 104 or along a direction there between. Transverse direction T is defined herein as a direction transverse to longitudinal direction L, such as extending across the width of toothbrush head 110. For applications such as electric toothbrushes, handle portion 102 may have suitable attachment means (not shown) located at proximal end 106 for securing toothbrush 100 to a power source or driving means.

Toothbrush head 110 has a head surface 112 from which bristles 114 extend. Bristles 114 may include one or more toe tufts 116 at the proximal-most end of head surface 112 configured for reaching a user's back teeth. Typically, a toe tuft is a larger bristle tuft that preferably has an angled contour, such as illustrated in the exemplary embodiment of FIGS. 1-4. Heel tuft 117 at the distal-most end of head 110 may also be included. Peripheral tufts 118 may optionally be provided, extending from head surface 112, and particularly configured for cleaning the user's gums. The height of peripheral tufts 118 may be selected to be higher or lower than the height of any of the other cleaning bristles extending from head surface 112, depending on the desired cleaning effect of such bristles. In the embodiment of FIGS. 1-4, peripheral tufts 118 are somewhat elevated or higher than the interior bristles (the bristles lying closer to the centerline of head 110) to clean the user's gumline effectively, particularly along the gingival margin. Also, each tuft along the periphery of head 110 may be profiled for additional cleaning benefits. For example, in the embodiment of FIGS. 1-4, peripheral tufts 118 are convexly curved to optimize cleaning efficacy.

The exemplary toothbrush illustrated in FIGS. 1-4 is an adult full-sized head. It will be appreciated that the principles of the present invention, to be detailed next, may be applied to other types of heads, such as compact heads, or the smaller-sized heads used on children's toothbrushes. For instance, more compact head designs may be obtained by not including a toe tuft, by eliminating various bristle tufts, and/or by adding some gum massagers for massaging the user's gums and/or for indicating if the toothbrush is being used with too much pressure against the gums and teeth.

The bristle profile (i.e., the profile or contour of the cleaning ends or free ends of the bristles, as seen from a side elevational view) of a toothbrush formed in accordance with the principles of the present invention is configured to provide superior interdental cleaning. The individual bristles used to achieve the inventive bristle tuft profile of the present invention may be generally circular in cross-section, with individual bristle diameters of between about 0.004 inch (0.1 mm) and about 0.014 inch (0.4 mm). However, other cross-sectional bristle shapes, such as oval, square, rectangle, hexagonal, plus-sign, star, etc., are also contemplated. Bristles are typically made of synthetic fibers, such as nylon 6,12. It will be appreciated that other materials may be used within the scope of the present invention. The free cleaning ends of the bristles may be formed in any desired manner, such as straight-cut, rounded, tapered, or otherwise contoured. It will be appreciated that the individual bristles need not all be identical to one another. For instance, bristles of different diameters or cross-sectional shapes may be provided on a toothbrush head 110 of a toothbrush 100 formed in accordance with principles of the present invention.

In accordance with one aspect of the present invention, bristles 114 on toothbrush head 110 include at least one preferably elongated tuft 120 shaped and configured to enclose, at least partially, an area. More particularly, elongated tuft 120 is "elongated" in the sense that the cross-sectional shape of such tufts (e.g., when viewed from a plan view, such as in FIG. 4) is not completely symmetrical, such as a circular cross-section. Preferably, elongated tuft 120 is "elongated" in the sense that it is longer along one of a width or length of the cross-sectional shape thereof. Furthermore, elongated tuft 120 is configured to "enclose, at least partially, an area" in the sense that elongated tuft 120 is not substantially straight, but, instead, extends about an area such that an area is bound on more than one side by elongated tuft 120. For example, exemplary elongated tuft 120 of the embodiment of FIGS. 1-4 is V-shaped and thus partially encloses an area between the legs of the V shape thereof. In accordance with this same aspect of the present invention, bristles 114 on toothbrush head 110 further include a complementary-shaped tuft 122 shaped to complement the shape enclosed by elongated tuft 120. More particularly, complementary-shaped tuft 122 preferably is shaped at least to fit within the area enclosed by elongated tuft 120. Even more particularly, the shape of elongated tuft 120 defines a contoured interior shape 121 and complementary-shaped tuft 122 preferably has a complementary and most preferably matching contour following the contour of contoured interior shape 121 of elongated tuft 120. In other words, elongated tuft 120 and complementary-shaped tuft 122 are shaped to substantially match each other in shape to interfit or to be interconnected so that the set of tufts may interact with each other while remaining independently formed tufts nonetheless. For example, complementary-shaped tuft 122 of the embodiment of FIGS. 1-4 has a cross-sectional shape with at least a portion that is substantially triangular in cross-section to complement the interior angle formed by the inner bristles of elongated tuft 120 and the angular-shaped area enclosed by elongated tuft 120. In accordance with the principles of the present invention, one or both of the tufts in the combination of elongated tuft 120 and complementary-shaped tuft 122 may be contoured to form a unique bristle profile (i.e., contour formed by the bristle ends for contacting the user's teeth, such as may be seen along a side elevational view of head 110).

The tufts of a tuft grouping formed in accordance with the principles of the present invention described above are spaced apart from and independent of one another. Typically, tufts are spaced approximately 0.5 mm apart from one another to differentiate the tufts from one another as well to function substantially separately and independently from one another. In one embodiment of the present invention, the tufts of a tuft grouping preferably are contoured independently. More particularly, at least one tuft in a tuft grouping has a bristle profile different from the bristle profile of the other tufts of the tuft grouping. For instance, in the exemplary embodiment of FIGS. 1-4, elongated tuft 120 and complementary-shaped tuft 122 have angled bristle profiles, the angle of the bristle profile of elongated tuft 120 differing in at least one of degree and direction from the direction of the bristle profile of complementary-shaped tuft 122.

Elongated tuft 120 may have a planar or non-planar bristle profile. In the embodiment of FIGS. 1-4, elongated tuft 120 is V-shaped and is angled from the point of the "V" upwardly to the ends of the legs of the "V". As such, elongated tuft 120 presents a substantially planar cleaning surface that is angled with respect to the substantially planar surface of toothbrush head surface 112 from which the bristles extend. Complementary-shaped tuft 122 preferably has a bristle profile or contour different from that of elongated tuft 120. For instance, complementary-shaped tuft 122 may be contoured from any of its edges (e.g., one of the three corners of the complementary-shaped tuft 122 of the embodiment of FIGS. 1-4) across to the opposite edge (e.g., to another corner). The contouring of complementary-shaped tuft 122 may be complimentary to the contouring of elongated tuft 120. As illustrated in the exemplary embodiment of FIGS. 1-4, complementary-shaped tuft 122 presents a substantially planar cleaning surface that is angled downwardly toward head surface 112 in a direction opposite the direction in which elongated tuft 120 is angled.

As will be appreciated, the complementary contouring of elongated tuft 124 and complementary-shaped tuft 122 in accordance with the principles of the present invention provides a tuft grouping that can sweep around teeth and reach interproximal areas (via raised sections of elongated tuft 120 and complementary tuft 122) while also simultaneously polishing outer tooth surfaces (via lower sections of elongated tuft 124 and complementary-shaped tuft 122). For purposes of the present invention, a "raised section" of a bristle tuft formed in accordance with principles of the present invention is a section having free cleaning ends extending above other bristles of that tuft. Also for purposes of the present invention, a "lower section" of a bristle tuft formed in accordance with principles of the present invention is a section having free cleaning ends below the free cleaning ends of other bristles in that tuft.

As may be appreciated, provision of bristles in a bristle tuft having a height greater than the height of other bristles in the tuft generally permits such higher bristles to access interdental spaces better than the other bristles in the tuft and also to contour around non-flat or contoured surfaces. The shorter bristles provide lateral support to the higher bristles, imparting a degree of rigidity to improve cleaning efficacy, and also provide the ability to work with a contoured structure (e.g., tooth or gumline, tongue, etc.). It is believed that the provision of complementary shaped tufts in a grouping of tufts which are grouped together to interfit and having matching side contours to have a combined cross-sectional shape of a desired configuration (hereinafter a "tuft grouping") provides increased interdental cleaning capability over a single profiled tuft with at least one bristle of greater height than the other bristles in the tuft. Comparisons of toothbrush models based on principles of the present invention show better cleaning performance over various profiled toothbrushes (i.e., toothbrushes with bristles of differing heights) without tuft groupings as in the present invention. The complementary tufts of a tuft grouping formed in accordance with the principles of the present invention are capable of providing lateral support to one another, yet are spaced apart to permit a degree of independent movement among bristles of separate tufts in the tuft grouping. The improvement in cleaning capability of a tuft grouping formed in accordance with the principles of the present invention is believed to be due to not only the increased heightened bristles, but also the capability of bristles in each tuft to work somewhat independently of bristles in another tuft of the tuft grouping (i.e., not completely independently, since the tufts are closely spaced together, yet more independently than bristles in the same tuft). The individual tufts making up a tuft grouping thus work independently yet also synergistically together. In addition, the formation of the different tufts of a tuft grouping to have different profiles (e.g., elongated tuft 120 being angled in a first direction and complementary-shaped tuft 122 being angled in a different direction) is believed to provide enhanced cleaning efficacy over the same tuft grouping having a flat profile (in other words, all bristles in all tufts in the tuft grouping having the same height). Testing of an in vitro model has shown that biofilm removal interproximally is at least 19% greater in an exemplary tuft grouping as illustrated in the exemplary drawings than in a similar tuft grouping with a flat trim (no contour or trim profile, with all bristles of substantially the same height).

In accordance with a separate and independent aspect of the present invention, exemplary embodiment of FIGS. 1-4 also show additional optional tufts 134 and 134' which, preferably, together form a tuft grouping separate and independent from the tuft grouping formed by elongated tufts 120 and complementary-shaped tufts 122. Exemplary tufts 134 of the exemplary embodiment of FIGS. 1-4 have a generally elongated rectangular cross-section. Exemplary tufts 134' are formed by the substantially perpendicular intersections of tufts shaped similar to tufts 134. However, other cross-sectional shapes of tufts 134 and 134' are within the scope of the present invention. Tufts 134 and 134' may be arranged to form, together, an extended tuft grouping extending laterally and/or longitudinally along toothbrush head 110. In the exemplary embodiment of FIGS. 1-4, the tuft grouping of tufts 134 and 134' form an extended elongated tuft grouping extending laterally back and forth between the left and right sides of toothbrush head 110 and also longitudinally along toothbrush head 110 and generally along longitudinal axis L. More particularly, the tuft grouping of tufts 134 and 134' form a sawtooth tuft pattern, such as a "W" shape, on toothbrush head 110 of a toothbrush 100. The tuft grouping formed by tufts 134 and 134' may be configured to complement one or more tuft groupings of elongated tufts 120 and complementary-shaped tufts 122. Such configuration complements the arrangement of exemplary elongated tufts 120 and complementary-shaped tufts 122. However, other configurations of tuft groupings formed from tufts 134 and 134' are within the scope of the present invention.

In some embodiments, each of tufts 134 and 134' may be trimmed to have a combined profile of a predetermined configuration, preferably a unique bristle profile providing improved cleaning efficacy. If desired, such combined bristle profile may complement the bristle profile of tuft groupings such as formed by elongated tufts 120 and complementary-shaped tufts 122. For instance, the bristle profiles of tufts 134 and 134' may include raised sections with bristles higher than other bristles in the tuft for reaching into and cleaning interdental areas. In the exemplary illustrated embodiment, the "W" tuft pattern formed by tufts 134 and 134' have a bristle profile complementing the profile of the tuft groupings formed by elongated tufts 120 and complementary-shaped tufts 122. More particularly, tufts 134' have a cross-sectional shape angled to complement the outer angle of elongated tufts 120 and have a bristle profile angled to a different degree than the bristle profile of elongated tufts 120. In one embodiment, the bristle profile of tufts 134' may be angled in a direction opposite the direction in which the bristle profile of elongated tufts 120 are angled. It will be appreciated that other bristle profiles are within the scope of the present invention.

A toothbrush may be formed in accordance with the principles of the present invention using methods similar to those disclosed in U.S. Pat. No. 5,609,890, issued to G.B. Boucherie N.V. on Mar. 11, 1997, or U.S. Pat. No. 6,582,028 issued to MC Schiffer GmbH on Jun. 24, 2003, which patents are hereby incorporated herein by reference in their entireties.

If desired, any or all of the bristles of toothbrush 100 may be formed of a material which may whiten or remove stains from teeth. For instance, the bristles may be formed from calcium carbonate such as sold by Pedex GmbH, a brand of Lenzing Plastics GmbH of Wald-Michelbach, Germany. In a preferred embodiment, such bristles may be used to form tufts 134 and 134' arranged in a desired pattern along toothbrush head 110 to improve efficacy.

It will be appreciated that although only a pair of complementary tufts (an elongated tuft and a complementary-shaped tuft) is described herein, more than two tufts may be provided to form a combined tuft grouping formed of more than one tuft, each tuft of the grouping having a cross-section complementing one or more of the other tufts in the grouping. In accordance with the principles of the present invention, at least one tuft of such tuft grouping has a profile different from the profile of the other tufts in the grouping. More particularly, in accordance with the principles of the present invention, at least one tuft of such tuft grouping has an angled profile that is angled differently from the profile of the other tufts of such tuft grouping. Preferably, at least two tufts of such tuft grouping have angled profiles, the angled profiles differing from each other. Most preferably, at least one of the tufts at least partially surrounds at least one of the other tufts of such tuft grouping (i.e., at least one tuft at least partially encloses an area in which at least one other tuft grouping is provided in a shape complementing the interior shape formed by the elongated tuft).

Various embodiments of toothbrushes formed in accordance with the principles of the invention have been described above. Each embodiment is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

The present invention may be better understood with reference to the following examples.

EXAMPLES

Three brushes were constructed based on the exemplary embodiment of FIGS. 1-4, with V-tufts of different lengths. The control brush had no V-tufts.

Saliva inoculated hydroxyapatite ("HA") discs were grown aerobically at 35° C. for 7 days with once daily media exchanges performed for 5 days. Base Media (BM) with 12% Phosphate Buffered Saline was used for growth media. The $14^{th}$ and $15^{th}$ molars were brushed for 15 seconds, using 250 grams of added weight. Immediately after brushing, the biofilms were harvested by sonication. Dilutions were made in 0.1% Peptone Water and cell plating was used to measure cell viability, which is indicated in terms of log CFU/mL (Colony Forming Units). Results are based on the data from each brush formed in accordance with principles of the present invention run three times for a total of 3 times each. This allows for n=3 for each brush and a control of n=3. The amount of simulated plaque left behind was then assessed compared to a control to determine how much was removed based upon the brush head design. The table below summarizes the results:

Percent Interproximal Biofilm Removed versus Brush Head Design:

| Brush Head Design | % Reduction |
|---|---|
| Control | NA |
| 9.5 mm | 26.60 |
| 10.5 mm | 59.56 |
| 11.5 mm | 73.24 |

The table shows the significant improvement increase as the length of the bristles in the V-tufts (referenced in the chart above in terms of the height that the V-tuft rises above the flat section) increase.

The exemplary embodiment illustrated in the figures has several separate and independent inventive features, which each, at least alone, has unique benefits which are desirable for, yet not critical to, the present invention. Therefore, the various separate features of the present invention need not all be present in order to achieve at least some of the desired characteristics and/or benefits of the present invention. One or more separate features may be combined, or only one of the various features need be present in a formed in accordance with the principles of the present invention, whether or not explicitly indicated. Therefore, the present invention is not limited to only the embodiments specifically described herein. Another exemplary embodiment of the inventive features are illustrated in U.S. application Ser. No. 29/338,240, the contents of which are hereby incorporated in their entirety.

While the foregoing description and drawings represent exemplary embodiments of the present invention, it will be understood that various additions, modifications and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the invention being indicated by the appended claims, and not limited to the foregoing description.

What is claimed is:

1. A toothbrush comprising:

an elongated tuft of bristles shaped and configured to enclose, at least partially, an area, thereby forming an elongated bristle tuft having a contoured interior shape surrounding the partially enclosed area; and at least one complementary-shaped tuft of bristles positioned, at least partially, within the at least partially enclosed area enclosed by said elongated bristle tuft and being shaped to complement said contoured interior shape of said elongated bristle tuft;

wherein:

said elongated bristle tuft and said complementary-shaped bristle tuft extend from a substantially planar head surface of a toothbrush head;

said elongated bristle tuft has a bristle profile presenting a cleaning surface angled to a first degree with respect to said toothbrush head surface such that said elongated bristle tuft has a first section and a second section, with said cleaning surface at said first section being positioned higher than said cleaning surface at said second section;

said complementary-shaped bristle tuft has a bristle profile presenting a cleaning surface angled to a second degree with respect to said toothbrush head surface such that said complementary-shaped bristle tuft has a first section and a second section, with said cleaning surface of said complementary-shaped bristle tuft at said first section being positioned higher than said cleaning surface of said complementary-shaped bristle tuft at said second section, said cleaning surface of said complementary-shaped bristle tuft extending from said second section to said first section in a direction towards said second section of said elongated bristle tuft; and said cleaning surface of said first section of said complementary-shaped bristle tuft is positioned higher than said cleaning surface of said second section of said elongated bristle tuft, and said second degree differs from said first degree.

2. A toothbrush as in claim 1, wherein said bristle profile of said elongated bristle tuft and said bristle profile of said complementary-shaped bristle tuft are substantially planar.

3. A toothbrush as in claim 2, wherein:

said bristle profile of said elongated bristle tuft extends in a first direction angled with respect to said toothbrush head surface; and said bristle profile of said complementary-shaped bristle tuft extends in a second direction angled with respect to said toothbrush head surface in a direction opposite said first direction.

4. A toothbrush as in claim 1, wherein:

said bristle profile of said elongated bristle tuft extends in a first direction angled with respect to said toothbrush head surface; and said bristle profile of said complementary-shaped bristle tuft extends in a second direction angled with respect to said toothbrush head surface in a direction opposite said first direction.

5. A toothbrush as in claim 1, wherein:

said elongated bristle tuft is elongated and angled; and said complementary-shaped bristle tuft has a triangular cross-sectional shape fitting within an angled interior shape formed by said angled elongated bristle tuft.

6. A toothbrush as in claim 1, further comprising an additional tuft grouping formed from at least one additional tuft, wherein said additional tuft grouping:

extends along a side of said elongated bristle tuft opposite said at least partially enclosed area enclosed by said elongated tuft; and is spaced apart from and independent of said elongated bristle tuft.

7. A toothbrush as in claim 6, wherein said additional tuft grouping has a bristle profile angled with respect to said toothbrush head surface to a third degree different from said first degree with which said bristle profile of said elongated tuft is angled with respect to said toothbrush head surface.

8. A toothbrush as in claim 7, wherein said bristle profile of said additional tuft grouping is substantially planar.

9. A toothbrush as in claim 7, further comprising:

at least one additional elongated bristle tuft shaped and configured to enclose, at least partially, an area, thereby forming an at least one additional elongated bristle tuft having a contoured interior shape surrounding the at least partially enclosed area; and at least one additional complementary-shaped tuft of bristles shaped at least to fit within the at least partially enclosed area enclosed by said at least one additional elongated tuft and to complement said contoured interior of said at least one additional elongated bristle tuft.

10. A toothbrush as in claim 9, wherein said additional tuft grouping:

extends along a side of said at least one additional elongated bristle tuft opposite said at least partially enclosed area enclosed by said at least one additional elongated tuft; and is spaced apart from and independent of said elongated bristle tuft.

11. A toothbrush as in claim 9, wherein:

said at least one additional elongated bristle tuft and said at least one additional complementary-shaped tuft are arranged adjacent said elongated bristle tuft and said complementary-shaped tuft;

said additional tuft grouping extends along sides of said elongated bristle tuft and said at least one additional elongated bristle tuft opposite said partially enclosed areas enclosed by said elongated bristle tuft and said at least one additional elongated bristle tuft, respectively, to form an elongated tuft grouping pattern; and said additional tuft grouping has a bristle profile different from the bristle profile of said elongated bristle tuft and said at least one additional elongated bristle tuft.

12. A toothbrush as in claim 11, wherein:

said elongated bristle tuft and said at least one additional elongated bristle tuft are angled; and said additional tuft grouping is "W" shaped.

13. A toothbrush as in claim 12, wherein said additional tuft grouping is formed from more than one bristle tuft.

14. A toothbrush as in claim 6, wherein said additional tuft grouping is formed from more than one bristle tuft.

15. A toothbrush comprising:

a toothbrush handle having a proximal end and a distal end;

a toothbrush head positioned at said distal end of said toothbrush handle; and a first bristle tuft extending from said toothbrush head and having a first leg and a second leg joined to each other at a first section of said first bristle tuft, with said first leg and said second leg both extending from said first section to form a v-shape bounding an area on at least two sides, with said first leg extending along said area from said first section to an end of said first leg, said second leg extending along said area from said first section to an end of said second leg, a second bristle tuft extending from said toothbrush head and having a triangular shape, and being positioned in said area such that at least a portion of said second bristle tuft is positioned between said first leg and said second leg;

said first bristle tuft having a bristle profile presenting a cleaning surface that is angled such that said cleaning surface at said end of said first leg and said cleaning surface at said end of said second leg are both elevated above said cleaning surface at said first section;

said second bristle tuft having a bristle profile presenting a cleaning surface that is angled such that said cleaning surface at a first section of said second bristle tuft is elevated above said cleaning surface at a second section of said second bristle tuft, with said cleaning surface of said second bristle tuft extending from said second section to said first section in a direction towards said first section of said first bristle tuft; and said cleaning surface of said first section of said second bristle tuft is elevated above said cleaning surface of said first section of said first bristle tuft.

16. A toothbrush as in claim 15, further comprising one or more bristle tufts extending from said toothbrush head and together forming an elongated tuft pattern extending longitudinally and laterally along said toothbrush head.

17. A toothbrush as in claim 16, wherein said elongated tuft pattern has a bristle profile presenting a complex cleaning surface angled in more than one direction with respect to said toothbrush head surface.

18. A toothbrush as in claim 16, wherein said elongated tuft pattern is sawtooth-shaped.

19. A toothbrush as in claim 18, wherein said sawtooth-shaped elongated tuft pattern has angled sections alternately presenting raised sections and lower sections of said elongated tuft pattern.

20. A toothbrush as in claim 16, wherein said elongated tuft pattern has angled sections alternately presenting raised sections and lower sections of said elongated tuft pattern.

* * * * *